United States Patent [19]

Scott

[11] Patent Number: 4,622,787

[45] Date of Patent: Nov. 18, 1986

[54] MULTIPLE UNIT HOUSING SYSTEM

[75] Inventor: Samuel P. Scott, Blackshear, Ga.

[73] Assignee: Scott Housing Systems, Inc., Waycross, Ga.

[21] Appl. No.: 696,779

[22] Filed: Jan. 31, 1985

[51] Int. Cl.[4] ..... E04D 1/36; E04B 1/348

[52] U.S. Cl. ..... 52/58; 52/62; 52/79.1; 52/79.7; 52/79.8; 52/143

[58] Field of Search ..... 52/58, 60, 62, 79.1, 52/79.6, 79.7, 79.8, 143

[56] References Cited

U.S. PATENT DOCUMENTS 2,795,014 6/1957 Kelly ..... 52/79.7
2,807,061 9/1957 Stone ..... 52/74
4,124,964 11/1978 Juriss et al. ..... 52/79.9 X

FOREIGN PATENT DOCUMENTS 186809 10/1922 United Kingdom ..... 52/79.8
1011917 12/1965 United Kingdom ..... 52/79.9

*Primary Examiner*—Alfred C. Perham
*Attorney, Agent, or Firm*—Louis T. Isaf

[57] ABSTRACT

A housing system formed of a plurality of separate, preconstructed living units which housing system is characterized by a unique roof joint system wherein one of the adjacent living units comprises an overhanging casing protruding from and running along the length of its roof edge and the adjacent living unit comprises an uprising flange element extending along the length of its roof edge; and further characterized in that the roof edges of adjoining living units need not be equal in height and the length of any unit comprising the housing system need not be equal to the length of any other unit within the housing system. The present invention allows for a multitude of new and different housing designs for preformed, transportable homes.

2 Claims, 19 Drawing Figures

MULTIPLE UNIT HOUSING SYSTEM

FIELD OF THE INVENTION

The present invention relates generally to the field of pre-formed housing systems and more especially to pre-formed housing systems comprised of multiple units which are attached to form a single housing system at a set-up site. In its most specific embodiments, the present invention relates to the field of mobile homes having multiple, transportable living units for attachment into a single housing system at a set-up site.

BACKGROUND OF THE INVENTION

Over the years, a very large industry has been developed around the concept known as pre-formed homes. One branch of tne industry which is of particular importance throughout the United States and the world is the mobile home industry. Builders of mobile homes (or house trailers as they are sometimes called) have adapted to constructing larger and larger homes by preconstructing homes in portions, which portions are made to be attached together at some distant location. Each individual portion of the preconstructed home is made of a size small enough to be legally transported on roads and highways, yet when the portions are finally attached together, the home is of a much greater size than could be transported. Throughout this specification, each individual portion shall also be referred to as a "living unit" or "unit" to indicate that it is a separately constructed unit comprising at least a portion of the living quarters of a home (albeit, a mobile home). The industry has developed what is known as double-wides (two transported units attached together at the distant location) and triple-wides (three portions separately transported and attached together at the distant site).

Although the industry has made great strides in the development or larger and larger "mobile" homes, there have been significant limitations by virtue of the means of construction, requirements of transportation, and concerns for stable, leak-proof final construction, all of which have militated against architecturally and artistically pleasing designs of the preconstructed homes.

In order to provide for environmentally sealed housing systems, and for other reasons, the industry has found it necessary to construct the individually transported living units in identical lengths; the ends of each unit being required to match-up. Interior doorways, passages, and free spaces must be meticulously and intolerantly aligned from one unit to the next at the time of preconstruction so that, after set-up, all passageways and free spaces will properly match-up as one passes from one living unit portion into an adjacent living unit portion. Often times, a great deal of time and expense is expended at set-up to move and align passageways and freespaces of adjacent living units. Since the living units must match-up at their ends, it is frequently required that interior walls and trims be completely torn down and reconstructed at the set-up site in order to accomplish proper alignment.

Wall heights and floor-to-roof distances must also be meticulously and intolerantly constructed in the preconstruction stage in order that the roof and floor will match up at the time of set-up. It is not unusual for a great deal of time and expense to be wasted at the time of set-up while doing on-site gable work to saw off, shim up or otherwise rebuild or repair roof structures to match the peaks or roof edges of adjacent living unit portions. Such match-ups can be especially difficult in dealing with traditional triple-wides where the gable and peak portions of the two outer living units must separately and sequentially be matched to the respective, adjacent peaks of the inner living unit. Also, due, apparantly, to the sheer complication of preconstruction and alignment and roof sealing and other problems, the industry has been unable to or has avoided manufacturing and selling mobile homes with two or more roof peaks or with a peaked roof completely fabricated on a single living unit.

Furthermore, the industry traditionally provides for the sealing and covering of the roof joint between adjacent living units by the use of a "bridge cap". In such a construction, layers of sealant, felt paper (perhaps), and shingle are used to plug and overlay the gap formed between the two adjacent living units. Such "bridge cap" construction is not always desirable or efficient in sealing against rains and inclement weather. Also, the need for accurate alignment of adjacent roof peaks and edges makes the present methods of sealing roof joints critically important while at the same time making the chances of excellant construction less probable.

SUMMARY OF THE INVENTION

Briefly described, the present invention relates to a housing system formed of a plurality of separate, preconstructed living units which units are of similar or varying lengths and heights. Adjacent living units are outfitted with a unique roof joint system wherein one of the adjacent living units comprises an overhanging lip protruding from and running along the length of its roof edge and the adjacent living unit comprises an uprising flange element protruding from and extending along the length of its roof edge. When the two adjacent units are set-up side by side at the set-up site, construction is such that the overhanging lip of the one unit protrudes so as to overhang the uprising flange of the other unit in a "awning" manner; the overhanging lip and uprising flange combining to assist in directing rain away from the joint between the adjacent units. In preferred embodiments, an evironmental seal is completed by the positioning of a cover plate over the flange of the one unit and below the overhanging lip of the other unit, as is more clearly described below.

The invention is characterized by the unique roof joint system as briefly mentioned above. The invention is further characterized in that the roof edges of adjoining living units need not be equal in height. Rather, in the preferred embodiments of the present invention, that edge of one unit which bears the uprising flange described above is lower to the ground surface than is the edge which bears the overhanging lip member of the adjacent unit. Such inventive elements of the present invention provide for numerous and varying roof designs and pitches unattainable in the industry. Furthermore, such features allow for slight up and down adjustment of adjacent living units to align the adjacent floors without adversely affecting the roof joint.

The present invention is further characterized in that the length of any unit comprising the final housing system need not be equal to the length of any other unit within the housing system. In the preferred embodiments, for example, a double-wide housing system may consist of two adjacent units each of differing lengths. In a triple-wide housing system of the preferred embodiments, the housing system may consist of three units, each of a differing length, or perhaps two units of the same length and one unit of a short length. Among other advantages, such uneven lengths allow for the back and forth adjustment between adjacent living units in order to overcome slight discrepancies in the match up between interior walls, passageways and free spaces. Such ability to adjust alignments of entire units on the set-up site greatly reduces the need for precise and intolerant accuracies in the initial preconstruction of each unit and lessens the need for expensive and time consuming rearrangement of interior walls at the time of set-up. Furthermore, this unique ability to utilize component units of varying size in a single housing system allows for a multitude of new and different housing designs.

As a result of the above features, the present invention also opens the way for both structurally and architecturally pleasing housing systems comprised of four, five, six and even more large, transportable living unit portions.

It is, therefore, an object of the present invention to provide a multiple unit housing system which allows for a vast variety of architectural designs.

Another object of the present invention is to provide a preconstructed, multi-unit housing system which uniquely allows minor errors at the time of preconstruction to be easily and cheaply overcome at the time of set-up.

Yet another object of the present invention is to provide a new and more flexible roof joining and sealing system for implementing the set-up of preconstructed, multiple unit housing systems.

Still another object of the present invention is to provide a preconstructed, multiple unit housing system which lessens, as compared to the prior art, the need for expensive, precision preconstruction.

Other objects, features and advantages of the present invention will become apparent upon reading the following specification, when taken in conjunction with the accompanying drawings.

DETAILED DESCRIPTION OF THE PREFERRED EMBODIMENTS

Figure 1:
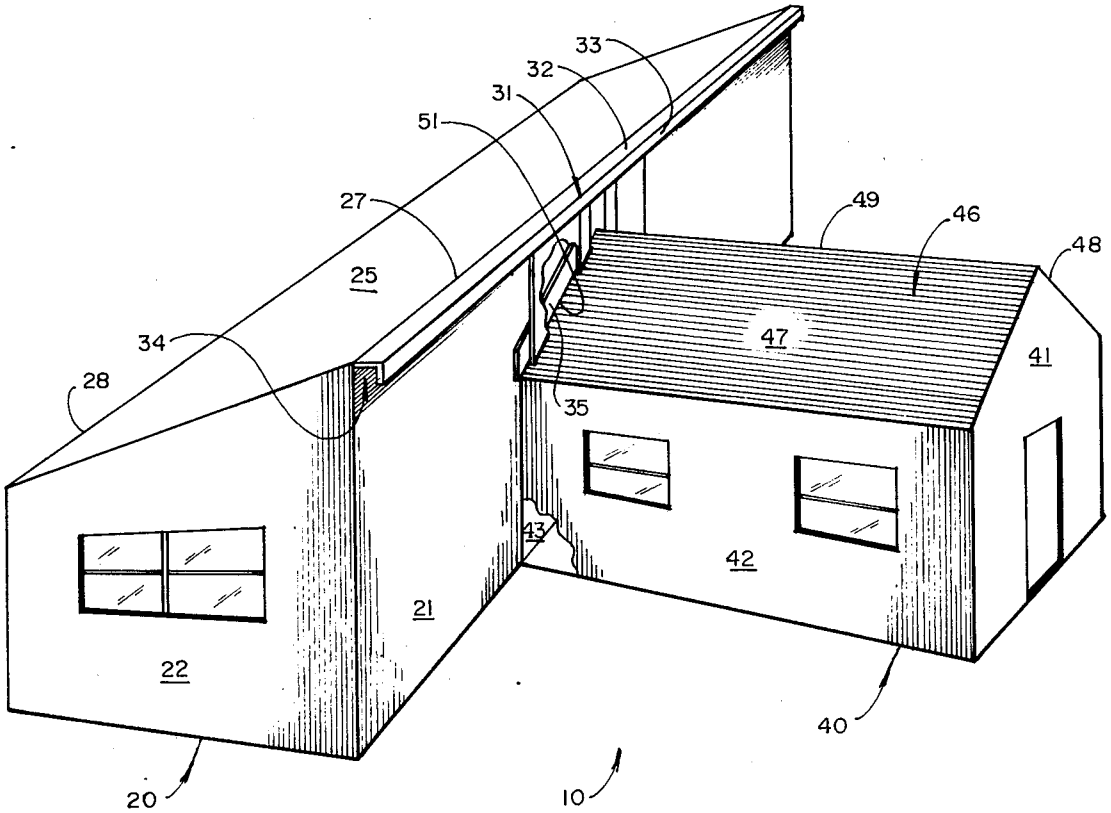
FIG. 1 is a pictorial view of one embodiment of a double-wide, multiple unit housing system in accordance with the present invention.

Referring now in greater detail to the drawings in which like numerals represent like components throughout the several views, FIG. 1 shows a multiple unit housing system 10 in accordance with the present invention which is formed from the attachment of two, independant, preconstructed living units (first living unit 20 and second living unit 40). Two side walls, 21, 22 of the first living unit 20 are seen in FIG. 1. Though not seen in FIG. 1, the first living unit 20 has a third side wall (23) opposing side wall 21 and a forth side wall (24) opposing side wall 22. The roof 25 of the first living unit 20, in the embodiment of FIG. 1, is a slanted or pitched roof slanting downward from the top edge 27 of the side wall 21 to the shorter, top edge 28 of the side wall 23.

The second living unit 40 also has four side walls 41, 42, 43, and 44. Side walls 41 and 42 are visible in FIG. 1, but it is understood that a third side wall 43 (see breakaway) opposes side wall 41 and a fourth side wall 44 opposes side wall 42. It can be seen that the second living unit comprising a pitched and peak roof 46 which includes a first pitched roof portion 47 and a second pitched roof portion 48 meeting at a peak 49.

Side wall 21 of the first living unit 20 and side wall 43 of the second living unit 40 are what is known typically in the industry as "marriage walls". That is, marriage walls are those respective walls of each living unit which are outfitted with doorways, passageways and free spaces which are opened to the environment until such time as they are brought into abutment with an adjacent living unit. Once brought into abutment with the adjacent living unit, the marriage walls coordinate doorways, passageways and free spaces to allow movement of residents from one living unit into the adjacent living unit while remaining within the interior of the finally assembled multiple housing unit system 10. For ease of identification, when referring to the embodiment of FIG. 1, the marriage wall 21 of the first living unit 20 will also be referred to herein as the abutment side wall 21; and the marriage wall 43 of the second living unit 40 will also be referred to herein as the engagement wall 43.

Figure 3:
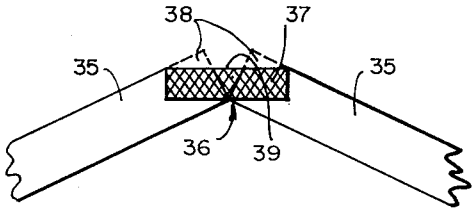
FIG. 3 is an isolated view of the flange member of FIG. 1 in accordance with the present invention.

Attached to and protruding outwardly from the top edge 27 of the abutment side wall 21 of living unit 20 is an elongated casing 31 which is formed of a support beam 32 and a downwardly extending lip beam 33. The orientation of the casing 31 defines in conjunction with the abutment wall 21 a trough 34 (an inverted or upside down trough) along the upper edge of, and to the outside of, the abutment wall 21. A flange member 35, is attached to and extends above the upper edge 51 of the engagement wall 43 of the second living unit 40. It will be noted that, in the particular embodiment of FIG. 1, the upper edge 51 of the engagement wall 43 is angular having two pitched portions (although one of the pitched portions is not in view in FIG. 1). For better detail, refer to FIGS. 3 and 4. As seen in FIG. 3, the flange member 35 is formed to correspond with the shape of the upper edge 51 of the engagement wall 43. In the preferred embodiment of FIG. 1, the flange member 35 is formed of a flexible, flashing type material which can be snipped or cut at a midway point to form the roof peak angles as indicated by 36 in FIG. 3. A material splice 37 is used to give strength and support to the flange member 35 at the bend 36. Preferrably, the tips 38 formed by the bending of the flange member 35 are cut away and discarded so as to form a flat edge 39 at the high point 39 of the flange member 35.

Figure 2:
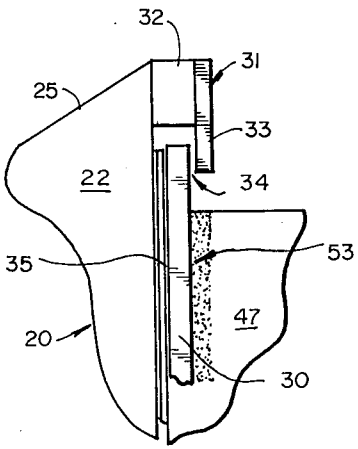
FIG. 2 is an isolated end view of the roof joint system in accordance with the present.

Referring back to FIG. 1, and with additional reference to FIG. 2, a tapered cover plate 30 is positioned on the roof 46 of the second living unit 40 along the upper edge 51 of the engagement wall 43. Such cover plate is to the outside of the flange member 35 such that the flange member 35 is positioned or "sandwiched" between the cover plate 30 and the abutment wall 21 of the first living unit 20. It is also noted, by reference to FIGS. 2 and 4, that the cover plate 30 is also positioned with the entire length of its upper most edge sheltered within the inverted trough 34 of the overhanging casing 31. With reference to FIG. 2, roofing tar or other sealant is applied to the point of intersection between the cover plate 30 and the roof 46 of the second living unit 40.

Figure 4:
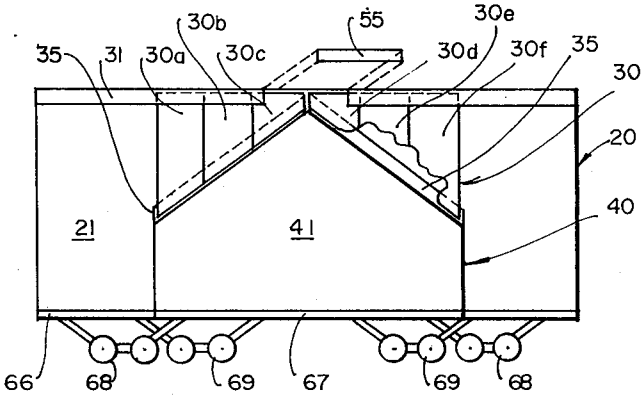
FIG. 4 is a side view of the multiple unit housing system of FIG. 1, showing parts exploded away, parts broken away and hidden parts shown by phantom lines.

The cover plate 30 of the particular embodiment of FIG. 1, is cut for ease of assembly into six sections (indicated as 30*a–f* in FIG. 4). These six sections of the cover plate 30 extend along practically the entire length of both the first pitched roof portion 47 and the second pitched roof portion 48 of the second living unit. The cover plates 30*a–f* are tapered to correspond with the pitch angle of the second living unit roof 46.

FIG. 4 further shows the first living unit 20, mounted on a trailer 66 outfitted with wheels 68 for transporting of the individual unit 20 along highways to the set-up site. The second living unit 40 is shown mounted on its own trailer 67 outfitted with wheels 69 for transporting of the second unit to the set-up site.

Figure 5:
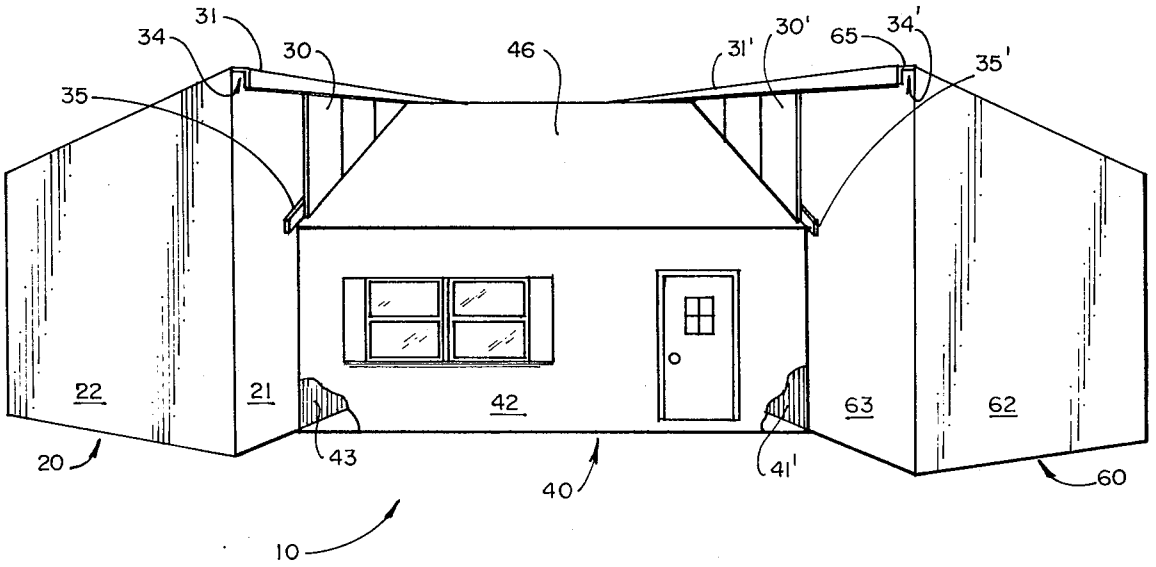
FIG. 5 is an isometric end view of one embodiment of a triple-wide, multiple unit housing system in accordance with the present invention.

FIG. 5 shows an alternate embodiment of the multiple unit housing system 10 of the present invention, which embodiment comprises three living units attached together to form a single multiple unit housing system. In this "triple-wide" embodiment of FIG. 5, there exist again a first living unit 20 which comprises an abutment side wall 21; again, a second living unit 40 comprising an engagement side wall 43 and a pitched and peak roof structure 46. Again, the unique roof joining and sealing system is used as part of the attachment technique for the first second living units. The roof joining system includes: the overhanging casing 31 attached to the top edge 27 of the abutment side wall 21; the flange member 35 attached to the upper edge 51 of the engagement wall 43; and the cover plates 30, all as previously described. This triple-wide embodiment of FIG. 5 further comprises a third living unit 60 which is attached to the second living unit 40 at the side wall which, in the embodiment of FIG. 1, would have been side wall 41. In this embodiment, that side wall 41 shall be referred to as side wall 40' since it is somewhat different in this embodiment. The third living unit 60 has four side walls 61, 62, 63, and 64 (side walls 61 and 64 are not seen in the view of FIG. 5). Side wall 63 of the third living unit and the side wall 41' of the second living unit are, in this embodiment, "marriage walls" in that they comprise the interior doorways, passageways and free spaces for free movement between the two adjacent living units 40, 60. In order to stay with the nomenclature previously used, and in order to establish a common nomenclature throughout this specification, side wall 41' of the second living unit 40 will be termed an engagement side wall and side wall 63 of the third living unit 60 shall be termed an abutment side wall. Hereafter in this specification, engagement side walls will be those "marriage walls" to which a flange member, such as flange member 35, is attached (regardless of the living unit being considered); and an abutment side wall shall refer to any marriage wall to which an overhanging casing, such as casing 31, is attached (regardless of the living unit being discussed).

With reference again to FIG. 5, an overhanging casing 31' is attached to the top edge 65 of the abutment side wall 63 in a manner similar to casing 31 of living unit 20. A flange member 35' is attached along the upper edge 52 of the engagement side wall 41' in a similar manner to that of flange member 35 at engagement side wall 43. Tapered cover plates 30' are slid within the trough 34' of the casing 31' and overlay the flange member 35' to sandwich the flange member against the abutment side wall 63 of the third living unit 60. Again, a sealant is placed along the intersection of the cover plate 30' and the second living unit roof 46. Thus, FIG. 5 shows a triple-wide, multiple unit housing system 10 comprised of three side-by-side living units 20, 40, 60 which are attached together in roof sealing, leak proof manner using overhanging casings, uprising flange members and cover plates in the unique manner of the present invention.

It should be noted here that both the double-wide embodiment of FIG. 1 and the triple-wide embodiment of FIG. 5 comprise living units which are not of equal length. The term "length" used throughout this specification shall refer to the dimension along the direction of travel in the event the unit where supported on the trailer for transportation as indicated in FIG. 4. For example, the length of living unit 20 is the distance from side wall 22 to side wall 24. The length of living unit 40 is the distance between side walls 42 and 44. With additional reference to FIG. 5, the figure is drawn with the intent of indicating that the third living unit 60 extends further to the front of said wall 42 that does the first living unit 20. That is, with reference to FIG. 6, side wall 62 is further in front of side wall 42 than is side wall 22.

Figure 6:
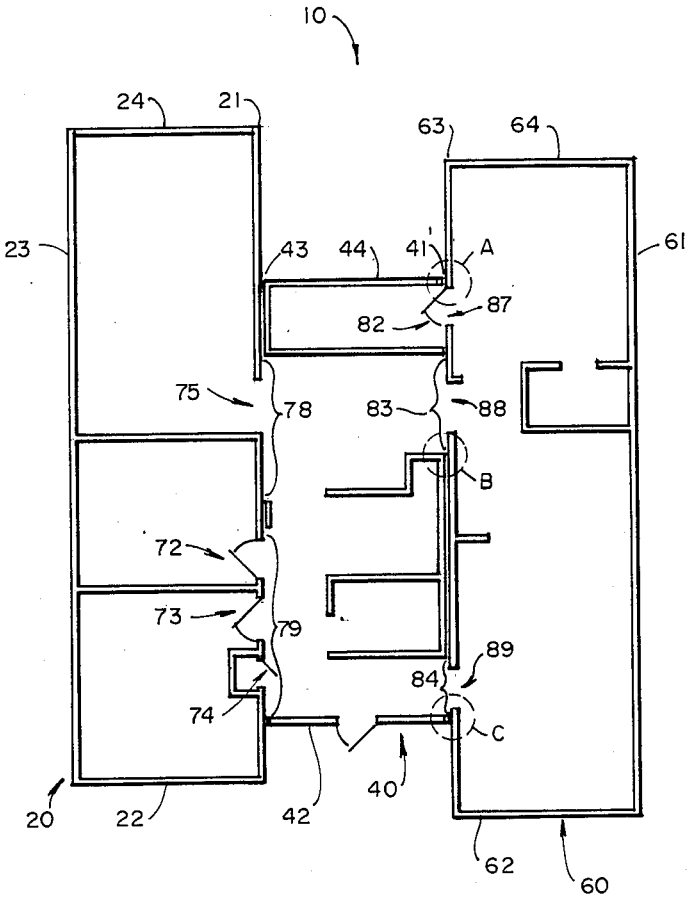
FIG. 6 is a floor plan for the interior of the multiple unit housing system of the embodiment of FIG. 5.

The relative construction of the respective marriage walls of the individual living units 20, 40, 60 will be discussed in reference to the triple-wide embodiment of FIG. 5 by reference to the floor plan of FIG. 6. This is simply a sample floor plan and the invention is in no way to be limited to the particular plan disclosed. FIG. 6 shows living unit 20, living unit 40 and living unit 60 placed side by side after set-up. The respective marriage wall 21, 43, 41', 63 are shown in floor plan view. Marriage/abutment wall 21 of living unit 20 is shown to have three doorways 72, 73, 74 and a fourth passageway 75 without a door. Two of the doorways 72, 73 possess hanging doors which swing in the first living unit 20 while one of the doorways 74 possesses a hanging door which swings outwardly from the first living unit 20 and thus into the second living unit 40. The marriage/engagement wall 43 comprises two, long free spaces 78, 79 spaning between solid wall portions. The marriage/engagement wall 41' comprises a passageway 82 and two free space areas 83, 84 all of which interrupt the solid wall member. Marriage/abutment side wall 63 includes a doorway 87, with a hanging door that swings away from the third living unit 60 and into second living unit 40, and two passageways 88, 89, all of which interrupt the solid wall portions. It can be seen by studying this FIG. 6 that in order for proper flow to be accomplished, and in order for the proper swing of outwardly swinging doors (such as doorways 74 and 87) it is necessary for the respective doorways, freespaces and passageways to be properly aligned when the housing system 10 is finally set-up.

Preconstruction: Each of the living units 20, 40, 60 is preconstructed in a typical manner to include all of the appropriate interior and exterior finishings. Preferably, the flange member 35 is formed and attached to the respective engagement side wall 43, 41' at the time of preconstruction. Also, preferably, the overhanging casing 31 is formed at the time of preconstruction and attached to the respective abutment side wall 21, 63. In the preferred embodiment, the support beam 32 is permanantly attached to the top edge 27 of the abutment wall 21 at preconstruction. The lip beam 33 is also, preferrably, permanently attached along the entire length of the support beam 32. The connections between the lip 33, support beam 32, abutment wall 21 and roof 25 are sealed against rain and other environmental conditions by using roofing tars, sealants and other roofing materials such as shingles which cover and protect the casing 31 at the time of preconstruction. In an alternate embodiment, the lip beam 33 is preconstructed with a removable mid-section 55 which is easily removed and reattached at the time of set-up. (See FIG. 4.) The purpose of this removal mid-section 55 is to allow for clearance of the high point 39 of the flange member 35 in the event that the roof peak 49 of the second living unit 40 is so high as to require the high point of the flange member to itself be tucked into the trough 34 of the casing 31. Thus, at the time of set-up, once the abutment wall 21 and engagement wall 43 have been brought into position abutting one another, the removable mid-section 55 can be replaced into the casing 31 covering any portion of the flange member 35 which extends into the trough 34. Cover plates 30 are, preferably, pre-cut to the proper lengths and taper and are placed inside one of the living units for safe storage until they are needed at the set-up site. Each of the living units 20, 40, 60 is mounted on a wheeled transporting trailer 66, 67 in a manner known and typical to the industry. In the case of house trailers or mobile homes the living units are permanently mounted to their respective trailers 66, 67. In the case of modular type housing, the individual units are placed upon trailers for later removal therefrom.

Set-up: With reference to all of the above described elements and features, a description of these features and elements as they relate to set-up of the housing system 10 at a permanent or semi-permanent site is described below. Each living unit 20, 40, 60 is separately transported, for example by truck, along highways to a chosen set-up site where they are set side-by-side and brought into close abutment with one another in accordance with their predesigned sequence (ie. first unit, then second unit, then third unit) by means and techniques typically known in the industry. Unique to the present invention, each engagement wall is brought into position against its respective, adjacent wall 43, 41' such that the flange member 35, 35' is flush against the engagement wall 21, 63.

Once the respective marriage walls are brought into position, the respective living units 20, 40, 60 are adjusted by moving them along their lengths for proper alignment of doorways, free spaces and passageways. The floor plan of FIG. 6 is helpful in pointing out the unique adjustment features of the present invention. Although, in some locations along abutting walls, there is very great clearance with little concern for blockage of openings, there are some locations where clearance and alignment are critical. Attention is drawn to the marriage of passageway 82 and doorway 87 where, at intersection point "A", an error of just a few inches could result in the end wall 44 blocking the doorway 87. Attention is also directed to two other critical points "B", "C" where slight errors of a few inches in preconstruction of either the second living unit 40 or the third living unit 60 could result in blockage of a passageway 88, 89. Since adjacent living units, in the preferred embodiments, are of unequal lengths, and since it is not extremely important that the other units be exactly aligned at their end walls 24, 64 and 22, 62, then each of the units can separately be adjusted along its length so as to compensate for minor preconstruction errors at critical points such as "A", "B", and "C". The unique nature of the roof joining system of the present invention also assists in this lengthwise movement and adjustment since, by virtue of the nature of the roof joining system, a proper roof joint and seal can be accomplished regardless of the position of the abutment walls 43, 41' along the lengths of the respective, adjacent engagement wall 21, 63.

Once the lengthwise adjustments have been completed to align openings, the respective living units 20, 40, 60 are aligned vertically by moving each unit separately up and down to assure that the floors of all three living units are level and on the proper horizontal plane or planes. Since there are no roof edges to match between the living units and the relative roof heights of the respective units are not extremely critical, reasonable vertical adjustments of one or more of the living units to overcome preconstruction errors can be easily and practically accomplished with the system of the present invention. Furthermore, the unique nature of the roof joining system of the present invention allows for a proper roof joint and seal regardless of the relative heights of the engagement walls 43, 41' and their respective, abutment side walls 21, 63.

Once all of the units are finally aligned and adjusted, the set-up crew simply takes the cover plates 30, 30' and slides them into position such that they are within the trough 34, 34' of the casing 31, 31' and sandwiching the flange member 35, 35' against the respective abutment wall 21, 63. In the event that adjustments are made to the relative heights of the adjacent living units, the cover plates 30, 30' can be modified for desired fit by simply trimming the top edge or an end of the plate. In the preferred embodiment, the cover plate 30, 30' is cut into small portions for ease of transportation and handling. At set-up, each portion is slid into its proper location by inserting it from the end of the casing 31, as in the view of FIG. 2. Once the cover plates 30, 31' are properly in place the roof tar of other sealant 53 is applied as indicated above. Proper sealant is also applied along the cut seams of the cover plates.

Figure 7B:
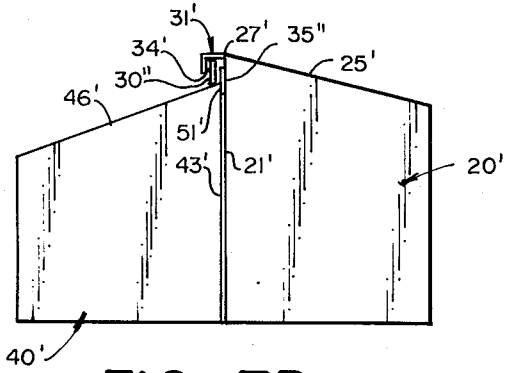
FIG. 7B is an end view of the housing system of 7A.
Figure 7A:
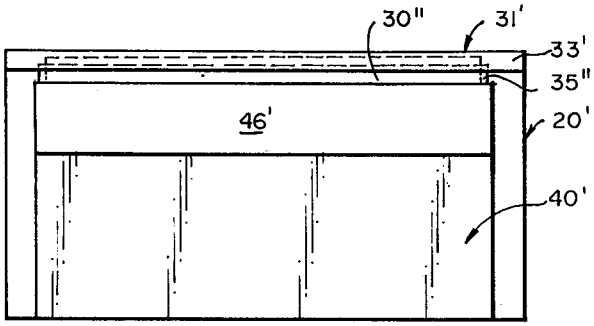
FIG. 7A is a side view of an alternate embodiment of the multiple unit housing system in accordance with the present invention.

Alternate Embodiments: In addition to the two embodiments of FIG. 1 and FIG. 5, in which the living units 20, 40, 60 are placed side by side with their lengths running parallel, the present invention envisions and encompasses numerous other embodiments which incorporate the features of the present invention. Some of the possible alternate embodiments, but not all of the possible embodiments, are displayed in FIGS. 7–17. FIGS. 7A and 7B show a side view and end view respectively of a double-wide embodiment of the present invention. The embodiment of FIG. 7 includes a first living unit 20' and a second living unit 40' having oppositely slanted roofs 25', 46'. The second living unit 40' is shorter in length than the first living unit 20' (see FIG. 7A). The first living unit 20' includes an abutment side wall 21' and an overhanging casing 31' protruding from the top edge 27' of the abutment side wall. The second living unit 40' includes an engagement side wall 43' which is shorter in height than the abutment side wall 21' of the first living unit 20'. A flange member 35'' is attached to the outside of the engagement wall 43' along the upper edge 51' of the engagement wall 43'. A cover plate 30'' is slid into place, in accordance with the present invention, with its upper portion held within the inverted trough 34' of the casing 31' and its lower edge resting on the roof 46' of the second housing unit 40', while the cover plate sandwiches the flange member 35'' against the abutment side wall 21' of the first living unit 20'. It will be noted here that the upper edge 51' of the engagement wall 43' is a straight edge and not a peak as in the previous embodiment. Furthermore, the cover plate 30'' is an elongated, rectangular member rather than the tapered member of the previous embodiments.

It is within the scope of this invention for certain embodiments of the invention to eliminate the cover plate 30. With reference, for example to FIG. 7, the flange member 35'' protrudes into the trough 34' along the entire length of the flange member. That is, the flange member 35'' is not simply below the casing 31' but also protrudes into the trough for its entire length. In such a case, the cover plate, although still preferred, is dispensible.

Figure 8:
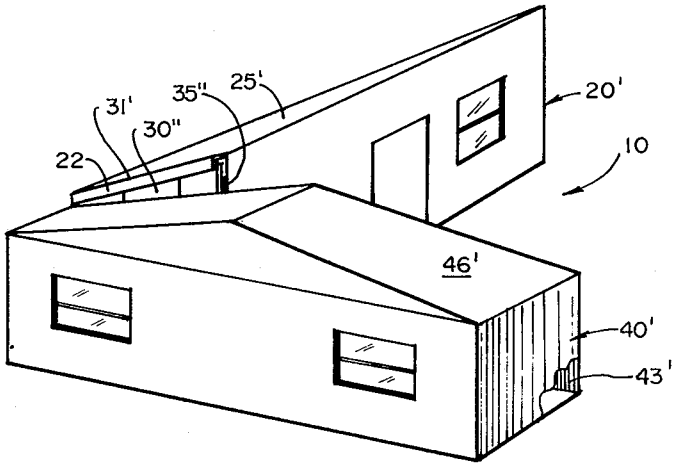
FIG. 8 is a pictorial view of a multiple unit housing system in accordance with the present invention, showing yet another alternate embodiment.

FIG. 8 shows an embodiment in which two living units 20', 40' are positioned with their lengths perpendicular to one another. Unlike the previous embodiments, the marriage wall of the first living unit 20' is one of the shorter side walls (ie. side wall 22). The first living unit 20' again has a pitched roof 25' and the second living unit 40' has a pitched and peaked roof 46' with a pitch which is at a lesser angle than that of the first unit roof 25'. It will be noted that the marriage wall 22 of the first living unit 20' is again the abutment side wall and carries the overhanging casing 31'. The marriage wall 43' of the second living unit 40' is again the engagement side wall carrying the flange member 35''. The cover plate 30'' of this embodiment is again tapered to match the angle between the two roofs 26', 46'.

Figure 9:
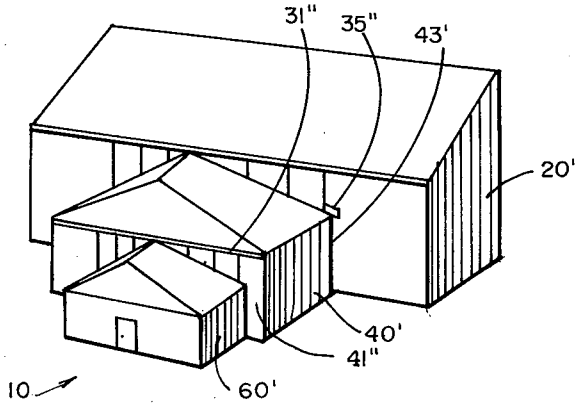
FIG. 9 is a pictorial view of a multiple unit housing system in accordance with the present invention, showing yet another alternate embodiment.

The alternate embodiment of FIG. 9 shows a multiple unit housing system 10 comprised of three living units 20', 40', 60'. This embodiment shows the mixing of varying roof structures and progressively smaller living units. This embodiment of characterized by the second living unit 40' having both an engagement side wall 43' which carries the uprising flange member 35''; and the same living unit 40' also includes an abutment side wall 41'' which carries the overhanging casing 31''.

Figure 10B:
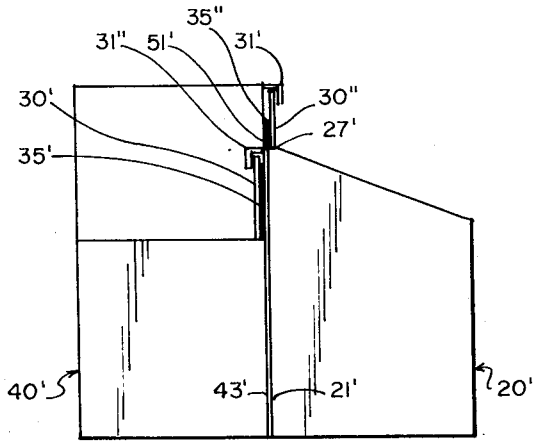
FIG. 10B is an end view of the housing system of FIG. 10A.
Figure 10A:
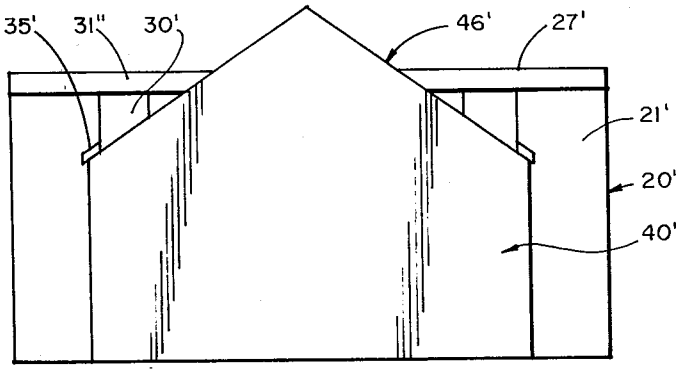
FIG. 10A is a side view of a multiple unit housing system in accordance with the present invention, showing yet another alternate embodiment.

FIGS. 10A and 10B disclose an embodiment in which the second living unit 40' includes a pitched and peaked roof 46' which begins below and extends above the top edge 27' of the side wall 21' of the first living unit 20'. In this embodiment, the respective marriage walls 21' and 43' serve as both abutment side walls and engagement side walls in that each marriage wall 21', 43' carries a flange member 35'', 35' attached to a portion of its upper edge 27', 51' and also carries an overhanging casing 31'', 31' at the remaining portion of its upper edge. This hybrid is shown in FIG. 10B.

Figure 11:
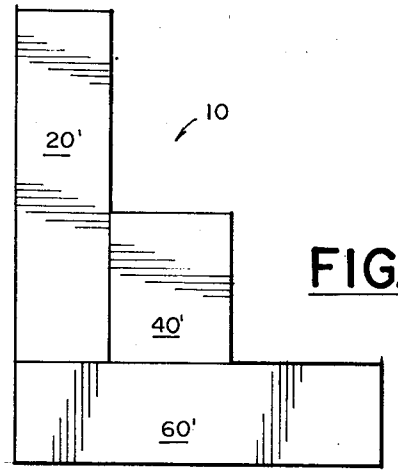
FIG. 11 is a plan view of a multiple unit housing system in accordance with the present invention, showing yet another alternate embodiment.
Figure 12:
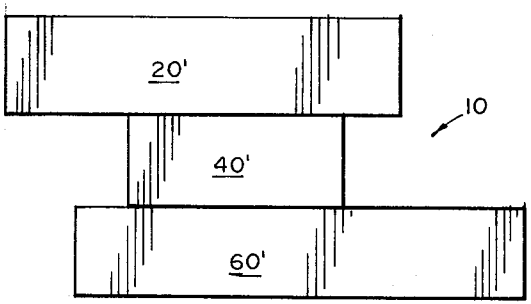
FIG. 12 is a plan view of a multiple unit housing system in accordance with the present invention, showing yet another alternate embodiment.
Figure 13:
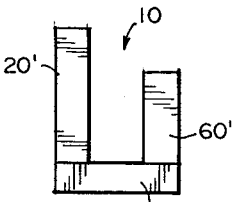
FIG. 13 is a plan view of a multiple unit housing system in accordance with the present invention, showing yet another alternate embodiment.
Figure 14:
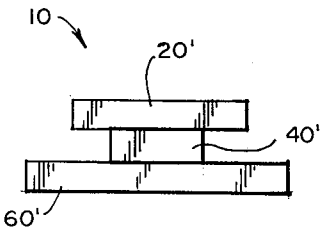
FIG. 14 is a plan view of a multiple unit housing system in accordance with the present invention, showing yet another alternate embodiment.
Figure 17:
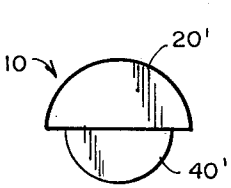
FIG. 17 is a plan view of a multiple unit housing system in accordance with the present invention, showing yet another alternate embodiment.
Figure 15:
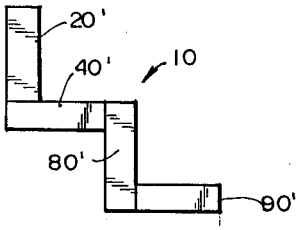
FIG. 15 is a plan view of a multiple unit housing system in accordance with the present invention, showing yet another alternate embodiment.
Figure 16:
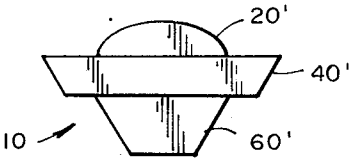
FIG. 16 is a plan view of a multiple unit housing system in accordance with the present invention, showing yet another alternate embodiment.

FIGS. 11–17 show planar views of various arrangements of living units which can be accomplished using the elements and techniques of the present invention, as described above. The invention is not limited by those designs which are disclosed in the drawings. Without describing all of the features presenting themselves in FIGS. 11–17, which in most cases will be self-explanatory in light of the above specification, some of the more interesting features are stated below. In FIG. 11, the second living unit 40' has marriage walls on two adjacent side walls rather than two opposing side walls. FIG. 16 makes use of a fourth living unit 90', indicating that the present invention is not limited as to the number of living units which can be attached to form the multiple unit housing system 10. FIG. 16 and FIG. 17 show housing units 10 which are formed by the attachment of two or more housing units 20', 40', 60' of unusual geometric configurations.

Whereas this invention has been described in specific detail with particular reference to the preferred embodiments thereof, it will be understood that variations and modifications can be effected within the spirit and scope of the invention as described hereinbefore and as defined in the appended claims.

I claim:

1. A multiple unit, transportable, housing system, comprising:

a first living unit comprising a plurality of side walls, at least one of said side walls being an abutment side wall, said abutment side wall including a lower edge and an upper edge supported in spaced relationship above said lower edge;

overhang member supported from said upper edge of said abutment side wall, said overhang member defining an inverted trough along at least a portion of said upper edge;

a second living unit comprising a plurality of side walls, at least one of said side walls being an engagement side wall, said engagement side wall including a lower edge and an upper edge supported in spaced relationship above said lower edge, said upper edge of said engagement side wall being supported above said lower edge of said engagement side wall at an angle to said lower edge;

flange member supported from and protruding vertically from said upper edge of said engagement side wall;

each of said first living unit and said second living unit being independantly and permanently mounted on a wheeled trailer and separately transportable from one location to another;

said abutment side wall and said engagement side wall being placed adjacent one another, said flange member of said second living unit abutting said abutment side wall of said first living unit, said flange member abutting said abutment side wall at a location below said overhang member thus defining a tapered gap between said flange member and said overhang member, and said inverted trough of said overhang member of said first living unit protruding beyond said abutment side wall to hang over said flange member;

removable, tapered plate member occupying said tapered gap, a portion of said plate member being positioned within said inverted trough of said overhang member and a portion of said flange member being sandwiched between said plate member and said abutment side wall;

whereby the first and second living units are separately transportable to a set up location, are movable into abutment, and combine to form a multiple housing system wherein the overhang member, flange member and taper plate member combined to assist in leak prevention between the first and second living units.

2. Housing System of claim 1, wherein said upper edge of said engagement side wall comprises a first edge beam and a second edge beam, each said beam being oriented at an angle to said lower edge of said engagement side wall, said first beam and said second beam intersecting to form a peak.

* * * * *